US012779290B2

(12) United States Patent
Presse, IV et al.

(10) Patent No.: US 12,779,290 B2
(45) **Date of Patent: *Nov. 3, 2026**

(54) GOLF CLUB WITH OFF-AXIS GRIP

(71) Applicant: L.A.B. Golf Company LLC, Creswell, OR (US)

(72) Inventors: Bill Presse, IV, Reno, NV (US); Scott Sulprizio, Carson City, NV (US)

(73) Assignee: L.A.B. Golf Company LLC, Eugene, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/366,396

(22) Filed: Oct. 22, 2025

(65) Prior Publication Data

US 2026/0048300 A1 Feb. 19, 2026

Related U.S. Application Data

(63) Continuation of application No. 18/911,898, filed on Oct. 10, 2024, which is a continuation of application No. 18/170,659, filed on Feb. 17, 2023, which is a continuation of application No. 15/058,188, filed on Mar. 2, 2016, now Pat. No. 12,011,640, which is a continuation-in-part of application No. 14/534,308, filed on Nov. 6, 2014, now abandoned, which is a continuation of application No. 14/219,929, filed on (Continued)

(51) Int. Cl.

| | |
|---|---|
| ***A63B 53/00*** | (2015.01) |
| ***A63B 53/04*** | (2015.01) |
| ***A63B 60/34*** | (2015.01) |

(52) U.S. Cl.

CPC ..... *A63B 53/007* (2013.01); *A63B 53/00* (2013.01); *A63B 53/0487* (2013.01); *A63B 60/34* (2015.10); *A63B 53/0408* (2020.08); *Y10T 29/49* (2015.01)

(58) Field of Classification Search

CPC ..... A63B 53/14

See application file for complete search history.

(56) References Cited

U.S. PATENT DOCUMENTS 807,224 A * 12/1905 Vaile ..... A63B 53/02 D21/736

1,631,504 A 6/1927 Redman (Continued)

FOREIGN PATENT DOCUMENTS

GB 727051 A 3/1955
GB 2362832 A 12/2001

(Continued)

OTHER PUBLICATIONS

Extended European Search Report (EESR) for EP Application No. EP 14785657, dated Nov. 15, 2016.

(Continued)

*Primary Examiner* — Nicholas J. Weiss
*Assistant Examiner* — Matthew B Stanczak
(74) *Attorney, Agent, or Firm* — Manatt, Phelps & Phillips, LLP

(57) ABSTRACT

A golf club such as a putter is disclosed where the club is self-balancing, providing a torque about its shaft axis to cause the face of the club to remain substantially square through a swing of the club; and in some aspects, the club can have a forward or a rearward lean, or an off-axis grip handle.

29 Claims, 17 Drawing Sheets

Related U.S. Application Data

Mar. 19, 2014, now Pat. No. 8,932,148, which is a continuation-in-part of application No. 13/865,708, filed on Apr. 18, 2013, now Pat. No. 9,233,280.

(56) References Cited

U.S. PATENT DOCUMENTS 1,703,199 A * 2/1929 McClure ..... A63B 53/0487 473/340
2,425,808 A * 8/1947 Jakosky ..... A63B 53/047 403/4
2,820,638 A * 1/1958 Morrison ..... A63B 53/007 33/286
2,843,384 A * 7/1958 Schmidt ..... A63B 53/007 473/294
3,319,962 A * 5/1967 Summers ..... A63B 53/007 473/251
3,459,426 A 8/1969 Sherwood
3,486,755 A 12/1969 Hodge
3,572,709 A * 3/1971 Risher ..... A63B 60/00 403/379.3
3,574,349 A 4/1971 Kropp
3,625,517 A * 12/1971 Durnack ..... A63B 53/007 473/340
3,655,188 A * 4/1972 Solheim ..... A63B 60/00 473/290
3,679,207 A * 7/1972 Florian ..... A63B 53/007 473/294
3,758,115 A * 9/1973 Hoglund ..... A63B 53/007 473/255
3,762,717 A * 10/1973 Johnston ..... A63B 53/02 473/324
3,954,265 A * 5/1976 Taylor ..... A63B 53/007 473/252
4,010,958 A * 3/1977 Long ..... A63B 53/0487 473/341
4,058,312 A * 11/1977 Stuff ..... A63B 60/24 73/65.03
4,063,733 A * 12/1977 Benedict ..... A63B 53/007 473/313
4,138,117 A * 2/1979 Dalton ..... A63B 53/0487 473/255
4,141,556 A * 2/1979 Paulin ..... A63B 53/007 473/253
4,163,554 A * 8/1979 Bernhardt ..... A63B 53/007 473/294
4,240,636 A 12/1980 Swenson
4,269,412 A * 5/1981 Hughes ..... A63B 60/34 473/204
4,310,158 A 1/1982 Hoffman
4,312,509 A * 1/1982 Grant ..... A63B 53/007 473/340
4,324,404 A 4/1982 Dian
4,325,553 A * 4/1982 Taylor ..... A63B 53/007 473/332
4,374,315 A 2/1983 Timbrook
4,426,083 A * 1/1984 Dishner, Jr. ..... A63B 53/007 473/294
4,746,120 A * 5/1988 Mockovak ..... A63B 53/14 473/301
4,921,253 A * 5/1990 Tesori ..... A63B 53/0487 473/341
4,932,662 A * 6/1990 Blaisdell ..... A63B 69/3632 33/508
4,986,544 A * 1/1991 Benson ..... A63B 53/0487 473/254
5,078,398 A * 1/1992 Reed ..... A63B 53/0487 273/DIG. 8
5,133,555 A * 7/1992 Bailey ..... A63B 53/14 473/201
5,160,141 A * 11/1992 Crews ..... A63B 53/02 473/340
5,228,332 A * 7/1993 Bernhardt ..... A63B 53/007 73/65.03
5,290,035 A * 3/1994 Hannon ..... A63B 53/007 473/340
5,308,068 A * 5/1994 Strand ..... A63B 60/00 473/251
5,333,863 A * 8/1994 Shenoha ..... A63B 53/007 473/341
5,409,220 A * 4/1995 Lombardo ..... A63B 53/007 473/316
5,454,564 A 10/1995 Kronogard
5,460,372 A * 10/1995 Cook ..... A63B 60/16 473/204
5,469,627 A 11/1995 Denny
5,470,070 A * 11/1995 Bendo ..... A63B 53/0487 473/341
5,544,879 A * 8/1996 Collins ..... A63B 60/20 473/316
5,551,696 A * 9/1996 Izett ..... A63B 60/22 473/226
5,571,052 A * 11/1996 Bolanos ..... A63B 53/02 473/340
5,575,473 A * 11/1996 Turner ..... A63B 53/14 473/298
5,588,920 A * 12/1996 Soong ..... A63B 60/52 473/318
5,620,379 A * 4/1997 Borys ..... A63B 60/00 473/340
5,624,329 A * 4/1997 Schneebeli ..... A63B 53/00 473/340
5,662,532 A * 9/1997 Mizumura ..... A63B 53/007 473/314
5,700,207 A 12/1997 Guthrie et al.
5,728,009 A 3/1998 Shanahan
5,749,792 A * 5/1998 Engfer ..... A63B 60/08 473/300
5,782,705 A * 7/1998 Solari ..... A63B 53/007 473/341
5,785,608 A * 7/1998 Collins ..... A63B 53/0487 473/294
5,830,075 A * 11/1998 Hirose ..... A63B 53/0487 473/340
5,830,082 A * 11/1998 White ..... A63B 53/00 473/294
6,083,115 A * 7/2000 King ..... A63B 53/007 473/341
6,083,123 A 7/2000 Wood
6,152,832 A * 11/2000 Chandler, III ..... A63B 53/007 473/313
6,350,208 B1 2/2002 Ford
6,506,128 B1 1/2003 Bloom, Jr.
6,634,956 B1 * 10/2003 Pegg ..... A63B 53/0487 473/340
6,663,499 B2 * 12/2003 Riseley ..... A63B 60/10 313/340
6,786,835 B1 * 9/2004 Carter ..... A63B 60/20 473/300
6,966,846 B2 11/2005 Bloom, Jr.
6,988,959 B2 * 1/2006 Pollman ..... A63B 53/0487 473/340
7,066,829 B1 6/2006 Lister
7,121,954 B2 10/2006 Charron et al.
7,125,341 B1 * 10/2006 D'Eath ..... A63B 53/0487 473/340
7,306,526 B2 * 12/2007 Baek ..... A63B 53/007 473/294
7,407,445 B2 * 8/2008 Pedraza ..... A63B 53/0487 473/340
7,494,422 B2 * 2/2009 Pegg ..... A63B 53/0487 473/340
7,524,247 B2 4/2009 Williams
7,635,310 B2 12/2009 Keough
7,691,004 B1 4/2010 Lueders
7,909,707 B2 * 3/2011 Klein ..... A63B 53/0487 473/313
8,096,893 B2 1/2012 Ferris

(56) References Cited

U.S. PATENT DOCUMENTS 8,734,266 B2 5/2014 David
8,858,356 B2 10/2014 Chu et al.
8,932,148 B2 * 1/2015 Presse, IV ..... A63B 53/007 473/340
9,017,183 B1 * 4/2015 Ambrose ..... A63B 60/24 473/297
9,044,655 B1 * 6/2015 Hanson ..... A63B 53/14
9,233,280 B2 * 1/2016 Presse, IV ..... A63B 53/065
9,415,291 B2 8/2016 Ota
9,421,439 B2 * 8/2016 McLoughlin ..... A63B 60/46
10,052,536 B1 * 8/2018 Janus, Sr. ..... A63B 60/02
10,682,557 B2 * 6/2020 Ambrose ..... A63B 60/08
11,628,347 B2 * 4/2023 Ambrose ..... A63B 53/007 473/226
12,011,640 B2 * 6/2024 Presse, IV ..... A63B 53/00
2002/0032074 A1 * 3/2002 Grieb ..... A63B 60/02 473/335
2002/0077191 A1 * 6/2002 Roelke ..... A63B 53/14 473/300
2002/0098905 A1 * 7/2002 Riseley ..... A63B 53/02 473/314
2002/0151376 A1 10/2002 Verne
2003/0046988 A1 3/2003 Yamaguchi et al.
2003/0064822 A1 * 4/2003 Arvidson ..... A63B 53/0487 473/313
2003/0130058 A1 * 7/2003 Ferris ..... A63B 69/3685 473/300
2003/0162599 A1 * 8/2003 Klein ..... A63B 53/007 473/316
2003/0186755 A1 * 10/2003 Kitabayashi ..... A63B 60/00 473/313
2003/0199332 A1 * 10/2003 Lindsay ..... A63B 60/00 473/305
2003/0211900 A1 * 11/2003 Novak ..... A63B 60/00 473/300
2003/0220149 A1 11/2003 Mills
2003/0228926 A1 * 12/2003 Wang ..... A63B 53/047 473/340
2003/0236128 A1 * 12/2003 Jackson ..... A63B 53/007 473/340
2004/0259655 A1 * 12/2004 Ferris ..... A63B 60/10 473/294
2005/0020381 A1 1/2005 Yamaguchi et al.
2005/0049066 A1 3/2005 Schweigert
2005/0049076 A1 * 3/2005 Schweigert ..... A63B 53/0487 473/340
2005/0137028 A1 6/2005 Lukasiewicz
2005/0215348 A1 9/2005 Baek
2005/0239573 A1 10/2005 Moriyama
2006/0009305 A1 * 1/2006 Lindsay ..... A63B 60/00 473/340
2006/0068929 A1 * 3/2006 Goldfader ..... A63B 60/12 473/294
2006/0142094 A1 6/2006 McCracken
2006/0156514 A1 7/2006 Lewis
2006/0199663 A1 9/2006 Lister
2006/0264264 A1 * 11/2006 Sandino ..... A63B 53/0433 473/248
2006/0281578 A1 * 12/2006 Pedraza ..... A63B 53/007 473/314
2006/0287130 A1 * 12/2006 Allen ..... A63B 53/0487 473/340
2007/0026959 A1 * 2/2007 Boone ..... A63B 53/14 473/300
2008/0058115 A1 * 3/2008 Bengtson ..... A63B 53/0487 473/340
2008/0230174 A1 * 9/2008 Huang ..... A63B 60/54 428/32
2008/0293513 A1 * 11/2008 Bitko ..... A63B 60/02 473/340
2008/0305880 A1 * 12/2008 Brown ..... A63B 69/3632 473/219
2008/0305885 A1 * 12/2008 Kinney ..... A63B 53/02 473/307
2009/0017936 A1 * 1/2009 Sato ..... A63B 60/00 473/341
2009/0069110 A1 3/2009 Schmidt
2009/0137332 A1 * 5/2009 Sussich ..... A63B 69/3632 473/223
2009/0186718 A1 * 7/2009 Ross ..... A63B 53/0487 473/340
2009/0227387 A1 * 9/2009 Pontius ..... A63B 53/0487 473/340
2009/0247315 A1 * 10/2009 Kossowsky ..... A63B 53/007 473/316
2010/0083518 A1 4/2010 Kramski
2010/0160062 A1 6/2010 Teramoto
2010/0160075 A1 6/2010 Dawson
2010/0298065 A1 11/2010 Soracco et al.
2011/0065525 A1 3/2011 Johnson
2011/0086731 A1 * 4/2011 Todd ..... A63B 60/42 473/409
2011/0183773 A1 * 7/2011 Cameron ..... A63B 53/007 473/282
2011/0294592 A1 * 12/2011 Guerriero ..... A63B 53/02 473/324
2012/0034990 A1 * 2/2012 Cohen ..... A63B 53/0487 473/250
2012/0196696 A1 * 8/2012 Guerriero ..... A63B 53/0487 473/325
2012/0214610 A1 * 8/2012 Parsons ..... A63B 60/06 473/409
2012/0283034 A1 * 11/2012 Morton ..... A63B 60/00 473/294
2013/0130825 A1 * 5/2013 McLoughlin ..... A63B 53/14 473/303
2013/0203514 A1 * 8/2013 Chu ..... A63B 53/14 473/203
2013/0210539 A1 * 8/2013 Baumann ..... A63B 53/0487 473/319
2013/0225306 A1 * 8/2013 David ..... A63B 60/02 473/409
2013/0331197 A1 * 12/2013 Hackenberg ..... A63B 60/02 473/251
2014/0045602 A1 * 2/2014 Dingman ..... A63B 60/10 473/201
2014/0148267 A1 * 5/2014 Pitbladdo ..... A63B 60/22 29/428
2014/0200097 A1 * 7/2014 Chu ..... A63B 53/007 473/303
2014/0213385 A1 * 7/2014 Chu ..... A63B 53/14 473/300
2014/0315655 A1 * 10/2014 Presse, IV ..... A63B 53/007 473/292
2014/0315656 A1 * 10/2014 Presse, IV ..... A63B 53/007 473/292
2014/0349775 A1 * 11/2014 Davis ..... A63B 53/02 473/409
2015/0045135 A1 * 2/2015 Patel ..... A63B 53/0487 473/293
2015/0182823 A1 * 7/2015 Hsu ..... A63B 53/0487 473/293
2015/0196813 A1 * 7/2015 Chu ..... A63B 60/14 473/303
2015/0209626 A1 * 7/2015 Klein ..... A63B 53/007 473/300
2015/0251064 A1 9/2015 Chapin
2015/0258390 A1 * 9/2015 DeFrancesco, Jr. ... A63B 53/02 473/313
2015/0265890 A1 * 9/2015 Presse, IV ..... A63B 53/007 29/592
2015/0367174 A1 12/2015 Okazaki
2016/0082329 A1 3/2016 Kammerer
2016/0096087 A1 * 4/2016 Sussich ..... A63B 53/02 473/340
2016/0107052 A1 * 4/2016 Wang ..... A63B 60/00 473/300

(56) References Cited

U.S. PATENT DOCUMENTS

| | | | | |
|---|---|---|---|---|
| 2016/0175665 | A1* | 6/2016 | Presse, IV | A63B 53/00 473/292 |
| 2016/0339310 | A1* | 11/2016 | Goldfader | A63B 53/007 |
| 2017/0087430 | A1* | 3/2017 | Ambrose | A63B 60/14 |
| 2017/0225046 | A1* | 8/2017 | Foster | A63B 53/007 |
| 2018/0021635 | A1* | 1/2018 | Lewis | A63B 53/0487 473/286 |
| 2018/0290033 | A1* | 10/2018 | Rife | A63B 60/24 |
| 2020/0298057 | A1 | 9/2020 | Wycoff | |
| 2021/0077883 | A1* | 3/2021 | Irvin | A63B 43/008 |
| 2021/0154550 | A1 | 5/2021 | Presby | |
| 2022/0288469 | A1 | 9/2022 | Liu | |
| 2023/0191208 | A1* | 6/2023 | Presse, IV | A63B 53/007 473/292 |
| 2023/0233914 | A1* | 7/2023 | Cameron | A63B 60/50 33/508 |
| 2025/0018260 | A1* | 1/2025 | Wilson | A63B 53/14 |
| 2025/0032863 | A1* | 1/2025 | Presse, IV | A63B 53/007 |
| 2025/0032869 | A1* | 1/2025 | Cavill | A63B 53/007 |
| 2025/0099819 | A1* | 3/2025 | Sood | A63B 53/007 |

FOREIGN PATENT DOCUMENTS

| | | | | |
|---|---|---|---|---|
| WO | WO-9217247 | A1 * | 10/1992 | A63B 53/007 |
| WO | 2007023693 | A1 | 3/2007 | |
| WO | 20090005439 | A1 | 1/2009 | |
| WO | 2012010609 | A1 | 1/2012 | |

OTHER PUBLICATIONS

International Search Report (ISR) for PCT Application No. PCT/IB2014/060782, dated Aug. 21, 2014.

* cited by examiner

GOLF CLUB WITH OFF-AXIS GRIP

RELATED APPLICATIONS

This application is a continuation of U.S. application Ser. No. 18/911,898 filed on Oct. 10, 2024, which is a continuation of U.S. application Ser. No. 18/170,659 filed on Feb. 17, 2023, which is a continuation of U.S. application Ser. No. 15/058,188 filed on Mar. 2, 2016, now U.S. Pat. No. 12,011,640, which is a continuation of U.S. application Ser. No. 14/534,308 filed on Nov. 6, 2024, which is a continuation-in-part of U.S. application Ser. No. 14/219,929 filed on Mar. 19, 2014, now U.S. Pat. No. 8,932,148, which is a continuation-in-part of U.S. application Ser. No. 13/865,708 filed on Apr. 18, 2013, now U.S. Pat. No. 9,233,280, all of which are incorporated herein by reference in their entirety.

BACKGROUND

When a golf club is not self-balancing, the golfer must balance the club in his/her stroke. That is, the golfer must put torque on the shaft in order to keep the face of the golf club square to the arc. This puts strain on the hands and arms of the golfer and makes it more difficult for the golfer to hit or putt successfully. Further, it means that the golfer must adjust to each golf club independently, because the amount and direction of torque required to square the golf club will vary depending on the golf club.

In order to be self-balancing a golf club must satisfy two conditions. It must "seek" square to the arc during a normal swing and it must do so when the shaft includes a forward lean. Many golf clubs claim to be self-balancing, however, they do so only when the shaft does not include forward lean. Since most golfers have forward lean in the shaft of their golf clubs, whether the golf club self-balances is irrelevant because it does not do so when in actual use.

A golf club can also be self-balancing when it is configured with rearward lean. Such a club requires additional design considerations relative to a forward leaning club, particularly with respect to the location of the attachment of the base of the shaft to the club head. Rearward lean is particularly useful for "face-on" or "side-saddle" putting where shaft length is greater than approximately 37 inches.

In addition, golf club grips do not conform well to the hands of the user. In particular, most club grips are round in shape. However, the hands of the user do not form a round shape. Therefore, the hands of the user must conform to the grip and there are areas of the grip with little or no pressure and areas of the grip with high pressure. Moreover, a round grip does not provide any type of tactile feedback to indicate to the user whether the club is properly aligned.

Accordingly, there is a need in the art for a golf club that will seek square with forward lean or rearward lean. Further, there is a need for the golf club to avoid putting torque or strain on the user. In addition, there is a need for the club to have a grip that conforms to the hands of the user and provides tactile feedback as to the correct alignment of the golf club. And, there is a need for the club grip to compensate for the lean angle of the club shaft to the club face irrespective of the location of placement of the hands along the grip.

SUMMARY

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a golf club. The golf club includes a club head. The club head includes a clubface configured to make contact with a golf ball. The golf club also includes a shaft attached to the club head. The shaft includes a center axis. The golf club further includes a grip which has a shape that can accommodate an angled channel, and may for example be elongated in an elliptical in shape, wherein the elongated grip includes a center axis. A hollow channel in the grip within which the shaft fits has a center axis that is: (a) non-parallel to the center axis of the grip when viewed from a point on the y-axis, (b) parallel to the center axis of the grip when viewed from a point on the x-axis; and (c) parallel to a major axis through the focal points of the elongated shaped grip.

Another example embodiment includes a golf club. The golf club includes a club head. The club head includes a clubface configured to make contact with a golf ball. The golf club also includes a shaft attached to the club head. The shaft includes a center axis, wherein the center axis converges with a balance point at an intersection of a lie angle radian and a lie angle axis. The golf club further includes a grip which has an angled channel, and may for example be elongated and elliptical in shape, wherein the grip includes a center axis through the length of the grip. A hollow channel in an elliptically shaped grip within which the shaft fits has a center axis that is: (a) non-parallel to the center axis of the grip when viewed from a point on the y-axis, (b) parallel to the center axis of the grip when viewed from a point on the x-axis; and (c) parallel to a major axis through the focal points of the elongated shaped grip.

Another example embodiment includes a golf club. The golf club includes a club head. The club head includes a clubface configured to make contact with a golf ball. The golf club also includes a shaft attached to the club head. The shaft includes a center axis, wherein the center axis converges with a balance point at an intersection of a lie angle radian and a lie angle axis. The balance point is at a position ($x=\pm x_1$, $y=\pm y_1$, $z=z_1$) in an imaginary Cartesian coordinate system defined around the club head. The imaginary Cartesian coordinate system includes an origin at the center of gravity of the club head and an x-axis defined as a horizontal line through the origin between the toe of the club head and the heel of the club head, where the clubface has a negative x location; The imaginary Cartesian coordinate system also includes a y-axis defined as a horizontal line through the original parallel to the clubface, where the heel of the club head has a negative y location for a right-handed player. The imaginary Cartesian coordinate system further includes a z-axis defined as a vertical line through the origin, where the top of the shaft has a positive z location. The position $z_1$ is the vertical distance between the origin and the attachment surface of the club head. The imaginary Cartesian coordinate system additionally includes a lie angle plane defined by the center axis of the shaft and a line parallel to the x-axis, wherein the line parallel to the x-axis is offset from the x-axis a distance $z_2$ along the z-axis. The imaginary Cartesian coordinate system further includes a radian plane parallel to the x-y plane offset a distance $z_1$ from the x-y plane, where the lie angle axis includes the intersection of the lie angle plane and the radian plane. The value of $y_1$ is calculated using the equation $$y_1 = \left|\frac{z_2 - z_1}{\tan a}\right|.$$

Where α is the lie angle of the center axis. The value of $x_1$ is calculated using the equation $$x_1 = \left|\frac{z_2 - z_1}{\tan a}\right|.$$

The golf club further includes a grip with dimensions such that the grip accommodates an angled channel within which the club shaft fits. The grip may, for example, be circular, square, elliptical, rectangular, triangular, or any number of other shapes. The shape may have one or more flat sides, or be a shape that is generally stretched. An elongated shape provides a cross section of the grip with a first dimension along a first axis being relatively longer than a second dimension along a second axis that is generally perpendicular to the first axis. In an embodiment of the invention with an elongated grip, a center axis is positioned through the length. In an elongated embodiment, a hollow channel in the grip within which the shaft fits has a center axis that is: (a) non-parallel to the center axis of the grip when viewed from a point on the y-axis, (b) parallel to the center axis of the grip when viewed from a point on the x-axis; and (c) parallel to a major axis through the focal points of the elongated shaped grip.

Another example embodiment includes a golf club. The golf club includes a club head. The club head includes a clubface configured to make contact with a golf ball. The golf club also includes a shaft attached to the club head. The shaft includes a center axis, wherein the center axis converges with a balance point at an intersection of a lie angle radian and a lie angle axis. The golf club further includes a grip which may for example be elongated in shape, wherein the elongated grip includes a center axis. A hollow channel in the grip within which the shaft fits has a center axis that is (a) non-parallel to the center axis of the grip when viewed from a point on the y-axis, (b) parallel to the center axis of the grip when viewed from a point on the x-axis; and (c) parallel to a major axis through the focal points of the elongated shaped grip.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1:
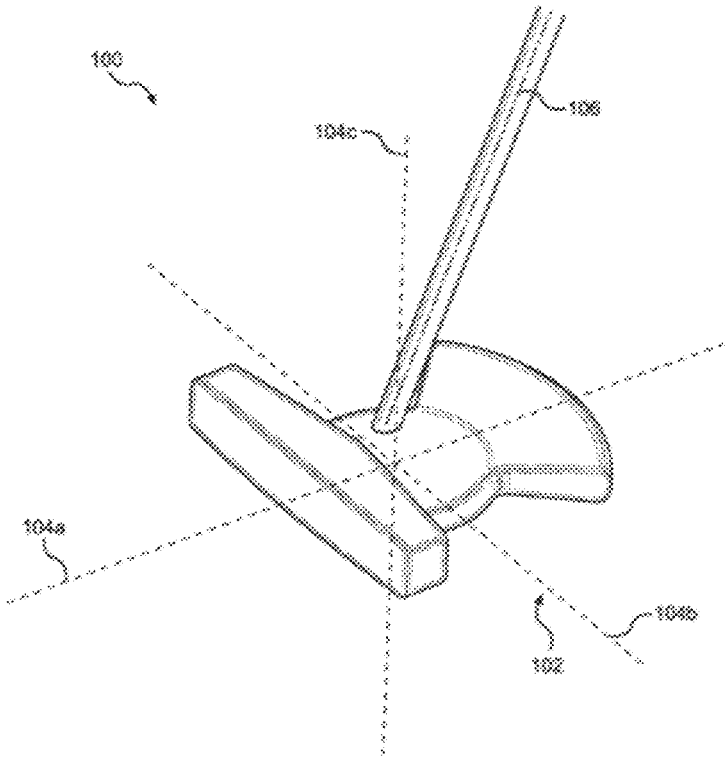
FIG. 1 illustrates an example of a self-balancing putter.

FIG. 1 illustrates an example of a self-balancing putter 100. A self-balancing putter 100 is a club used in the sport of golf to make relatively short and low-speed strokes with the intention of rolling the ball into the hole. It is differentiated from the other clubs (typically irons and woods) by a club head with a very flat, low-profile, low-loft striking face, and by other features which are only allowed on putters 100, such as bent shafts, non-circular grips, and positional guides. Putters 100 are generally used from very close distances to the cup, generally on the putting green, though certain courses have fringes and roughs near the green which are also suitable for putting. Although a putter is used as exemplary herein, one of skill in the art will appreciate that the principles disclosed herein can be used in any golf club.

FIG. 1 shows an artificial coordinate system 102 about the putter head 100. The origin on the Cartesian coordinate system 102 (i.e., the position x=0, y=0, z=0) is the center of mass (center of gravity) of the putter head 100. In physics, the center of mass of a distribution of mass in space is the unique point where the weighted relative position of the distributed mass sums to zero. I.e., the distribution of mass is balanced around the center of mass and the average of the weighted position coordinates of the distributed mass defines its coordinates.

FIG. 1 shows that the coordinate system 102 includes an x-axis 104*a*, a y-axis 104*b* and a z-axis 104*c*. The x-axis 104*a* runs through the face of the self-balancing putter. The face of the self-balancing putter 100 has a negative x position. The y-axis 104*b* is parallel to the face of the self-balancing putter 100. That is, the y-axis 104*b* is parallel to a line drawn to the center of one side of the face to the center of the other side of the face (if the clubface is symmetrical), such that the y-z plane (plane defined by the y-axis 104*b* and z-axis 104*c*) is parallel to the face of the self-balancing putter 100. The heel and toe of the self-balancing putter 100 have negative and positive y positions, respectively (vice versa for a left handed player). I.e., the heel is always closest to the player (for a right handed player this is always a negative y position, and for a left handed player this is always a positive y position). The z-axis 104*c* runs vertically through the center of gravity of the self-balancing putter 100. The top of the self-balancing putter 100 (e.g., top of the shaft, grip, etc.) has a positive z position. I.e., it is above the x-y plane.

Figure 2:
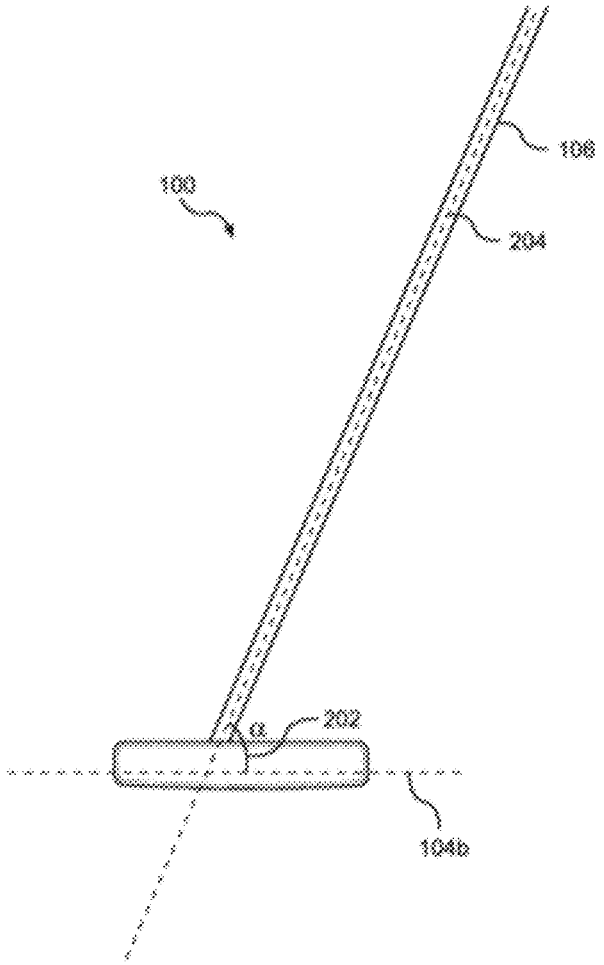
FIG. 2 illustrates the self-balancing putter of FIG. 1 looking down the x-axis at the face of the putter.

FIG. 2 illustrates the self-balancing putter 100 of FIG. 1 looking down the x-axis at the face of the putter. The lie angle 202 ("a") is defined as the angle formed between the center axis 204 of the shaft 106 and the sole, or ground line, of the self-balancing putter 100 when the self-balancing putter 100 is soled (flat on the ground) in its proper playing position (as at address), i.e., when the self-balancing putter 100 is soled on flat ground, with a straight line extending back from the heel of the self-balancing putter 100 along the ground (either the y-axis 104*b* or a line parallel to the y-axis 104*b*). The lie angle 202 is the angle from that line up to the shaft. That is, in the coordinate system 102 defined in FIG. 1, the lie angle 202 is the angle between the x-y plane and the axis 204 of the shaft 106 through the center point of the shaft 106. There is no "correct" or standard lie angle 202; the lie angle 202 that works for one golfer might be the wrong lie angle 202 for another golfer. The arc (vertical and horizontal) of a pendulum putting stroke is created by the lie angle 202 and length of the shaft. The flatter the lie angle 202 the more the same pendulum stroke appears to be inside to inside and the more upright the shaft lie angle 202 the more the putter head appears to swing back and down the line. The USGA has limited the upright lie angle 202 of a putter to be at least 10° off 90°.

Figure 3:
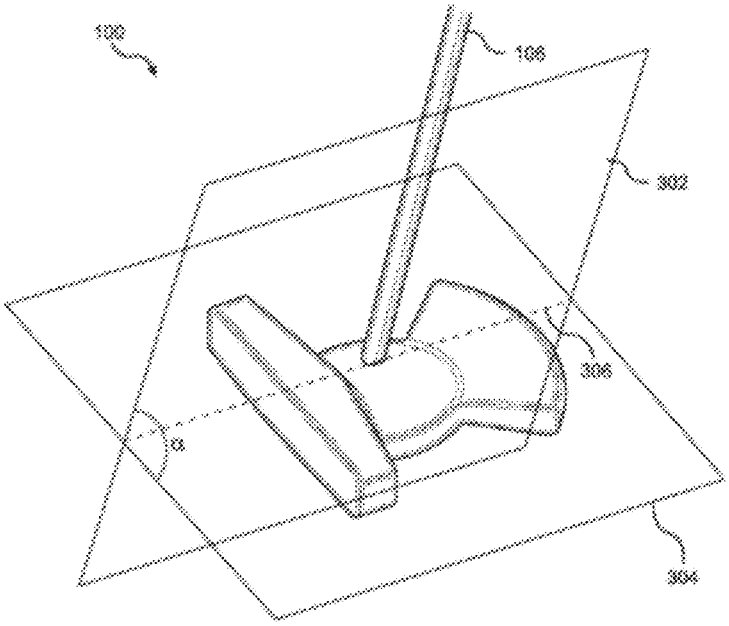
FIG. 3 illustrates a self-balancing putter with a lie angle plane.

FIG. 3 illustrates a self-balancing putter 100 with a lie angle plane 302. The lie angle plane 302 is a plane defined by the axis of the shaft 106 through the center point of the shaft and a line parallel to the x-axis 104*a* of FIG. 1 (i.e., a line parallel to the x-axis 104*a* and offset some amount along the z-axis 104*c* ("$z_1$")). That is, the lie angle plane 302 is similar to the x-y plane of FIG. 1 rotated about the x-axis 104*a* by the lie angle then offset along the z-axis 104*c* by the distance $z_1$. The value of $z_1$ can be a positive number, zero, or a negative number, i.e., the lie angle plane 302 is set at a specific distance from the center of mass. For example, the distance $z_1$ can be between 0.4 inches and 0.6 inches. E.g., the distance $z_1$ can be approximately 0.5 inches. As used in the specification and claims, the term approximately shall mean that the value is within 10% of the stated value, unless otherwise specified. One of skill in the art will appreciate that the center line of the shaft 106 with the specified lie angle must rest in the lie angle plane 302.

A radian plane 304 is also defined in FIG. 3. The radian plane 304 is parallel to the x-y plane of FIG. 1 and offset relative to the x-y plane of FIG. 1 by some distance ("$z_2$"), i.e., it is a plane with any x or y position but with constant z position of $z_2$. The distance $z_2$ is the vertical distance from the origin to the attachment surface. The distance $z_2$ can include a negative number, zero, or positive number. One of skill in the art will appreciate that the distance between the lie angle plane 302 and the radian plane 304 along the z-axis of FIG. 1 will be: $z_1$-$z_2$.

$$z_{total} = z_1 - z_2 \qquad \text{Equation 1}$$

FIG. 3 further shows a lie angle axis 306. The lie angle axis 306 is defined by the intersection of the lie angle plane 302 with the radian plane 304. That is, the lie angle axis 306 is a line parallel to the x-axis 104*a* of FIG. 1 but offset some distance along the y-axis 104*b* ("$y_1$") and a distance of $z_2$ along the z-axis 104*c*. The distance $y_1$ can be a negative number, positive number or zero and the distance $y_1$ need not be the same distance as distance $z_2$. Therefore, the position of the lie angle axis 306 will have any x value and is defined by the coordinates ($y=y_1$, $z=z_2$). One of skill in the art will appreciate that since the z-axis 104*c* of FIG. 1, the lie angle plane 302 and the radian plane 304 having a value of α, the value of $y_1$ can be calculated using the formula:

$$\tan a = \frac{z_{total}}{y_1} \xrightarrow{yields} y_1 = \left|\frac{z_{total}}{\tan a}\right| \qquad \text{Equation 2}$$

Figure 4A:
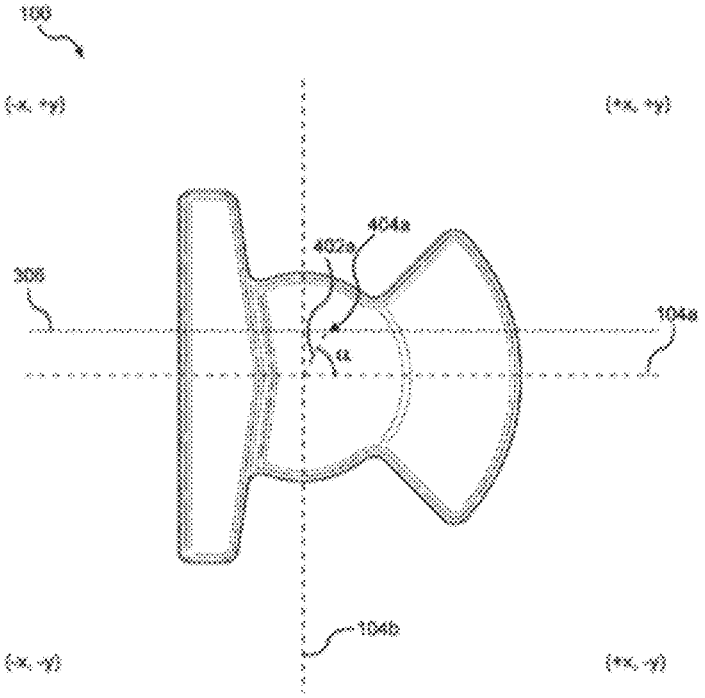
FIGS. 4A-B illustrate top views of the self-balancing putter with forward and rearward leaning shafts, respectively.
Figure 4B:
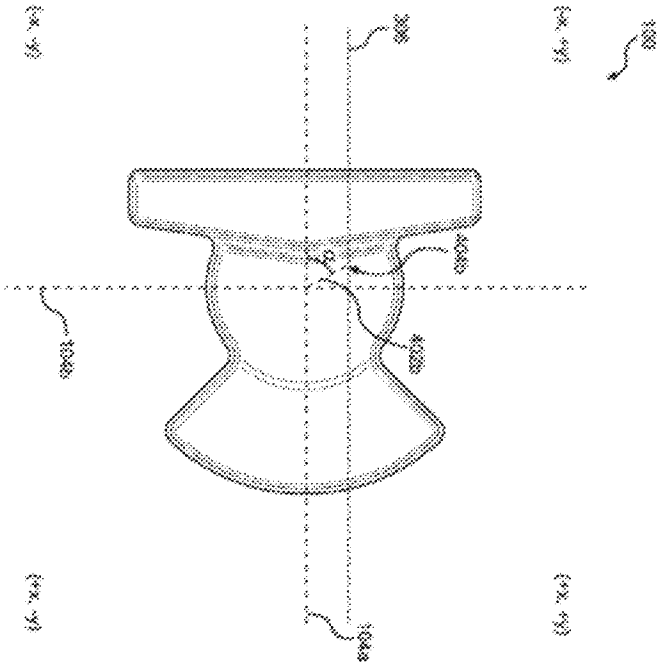

FIG. 4A illustrates a top view (i.e., down the z-axis) of the self-balancing putter 100. For simplicity's sake, the shaft of the putter is not shown in FIG. 4A, but it should be understood, that the shaft would be affixed to the putter head at balance point 404*a*. FIG. 4B also illustrates a top view (i.e., down the z-axis) of the self-balancing putter 100. As with FIG. 4A, the shaft of the putter is not shown in FIG. 4B, but again it should be understood, that the shaft would be affixed to the putter head at balance point 404*b*. In addition, the quadrants of the x-y plane are labeled. The z-axis is not shown but passes through FIG. 4A as can be determined from FIG. 1.

FIGS. 4A-B show two different lie angle radians 402*a*, 402*b* where lie angle radian 402*a* has a forward leaning shaft and lie angle radian 402*b* has a rearward leaning shaft. A rearward leaning shaft is preferred for face-on or side saddle putting in which a longer putter shaft of more than approximately 37 inches or so is typically employed. For both configurations, the balancing concepts are the same. The lie angle radian 402 origin is the z-axis (x=0, y=0) on the radian plane 304. The angle relative to the x-axis 104*a* of the lie angle radian 402 is always approximately equal to the lie angle. The lie angle radian 402 terminates at the lie angle axis 306. That is, the lie angle radian 402 is similar to the x-axis, offset along the z-axis by the same distance as the radian plane ($z_2$) and rotated by the lie angle (or the y-axis rotated by 90 degrees minus the lie angle) in a direction from the positive x-axis 104*a* to the positive y-axis 104*b* (or the negative y-axis 104*b* for a left-handed player). The lie angle radian 402 always terminates at the lie angle axis at a position ($x=\pm x_1$, $y=\pm y_1$) (the absolute value in Equation 2 ensures that the value of $y_1$ is always positive regardless of the z value). Right-handed players always have the lie angle radian 402 in the +x, +y quadrant, and left-handed players always have the lie angle radian 402 in the +x, −y quadrant. One of skill in the art will appreciate that, because the x-axis 104*a*, lie angle radian and line segment of distance $y_1$ can form a right triangle, the value of $x_1$ can be calculated using the formula:

$$\tan a = \frac{y_1}{x_1} \xrightarrow{yields} x_1 = \frac{y_1}{\tan a} \qquad \text{Equation 3}$$

Substituting Equation 2 into Equation 3 yields:

$$x_1 = \left|\frac{\frac{z_{total}}{\tan\alpha}}{\tan\alpha}\right| = \left|\frac{z_{total}}{\tan^2\alpha}\right| \text{ or} \qquad \text{Equation 4}$$

$$x_1 = \left|\frac{\frac{y_1}{z_{total}}}{y_1}\right| = \left|\frac{y_1^2}{z_{total}}\right|$$

The shaft center line always originates at a balance point 404 defined as the intersection of the lie angle radian 402 and the lie angle axis 306 (i.e., position x=±x.sub.1, y=±y.sub.1, z=z.sub.2). That is, the axis of the shaft through the center of the shaft (the same axis used to measure the lie angle), the lie angle axis 306 and the lie angle radian 402 all converge at a single point. One of skill in the art will appreciate that the shaft can be rotated about this point. I.e., the axis of the shaft can be moved within the lie angle plane 302 (otherwise, the lie angle would be changed) as long as the balance point 404 remains the same. This can allow the self-balancing putter 100 to be customized to the user based on the lie angle preferred by the user. The balance point is configured to make the club face seek square when making contact with the golf ball. As used in the specification and the claims, the phrase "configured to" denotes an actual state of configuration that fundamentally ties recited elements to the physical characteristics of the recited structure. As a result, the phrase "configured to" reaches well beyond merely describing functional language or intended use since the phrase actively recites an actual state of configuration.

One of skill in the art will appreciate that the shaft may, but is not required to, attach to the balance point 404 (even though the center line of the shaft will still intersect with the balance point 404). In particular, the shaft may have a bend or curve near the balance point 404. Thus the lie angle axis 306 of FIG. 3 is not necessarily contiguous with the shaft. Additionally or alternatively, the shaft can be attached to a hosel. The hosel is a portion of the self-balancing putter 100 head to which the shaft attaches. Though largely ignored by players, hosel design is integral to the balance, feel and power of a self-balancing putter 100. A hosel can be a separate piece attached to the club head and can connect to the shaft internally or externally and it can be bent. In addition the rules of golf consider a bend in the shaft to be a type of hosel.

Because the balance point 404 is the intersection of the lie angle axis 306 and the lie angle radian 402, the putter head will be balanced to match the lie angle of the shaft relative to the ground line. This is critical to keep the face square to the arc of the stroke without any outside influences or any torsion forces from the golfer's hands.

The balance point 404 at the intersection of the lie angle axis 306 and the lie angle radian 402, with shaft lean that is either forward or rearward in direction, will keep the putter face perpendicular to the arc that the lie angle and length creates throughout the back swing, transition and forward stroke and impact. If the shaft attaches at a different point, the self-balancing putter 100 is not swung on the lie angle that the shaft creates (which is limited to 80° upright, as described above). This eliminates the possibility of a toe down or variations thereof, toe up or variations thereof, face balanced or variations thereof or face straight down self-balancing putter 100 ever being able to remain naturally balanced face on and perpendicular to the arc the self-balancing putter 100 swings on without outside influence from the hands.

The benefit of this balancing is to keep the face square to the arc without tension or manipulation of the large and small muscles in the arms and hands. Being able to reduce tension in your hands and arms allows a golfer to focus on acceleration for proper distance control without also thinking about face angle (direction and path) at impact, i.e., by inserting or aligning the shaft not directly above the center of mass it creates an extra lever that resists twisting on any strike and in fact self corrects without any outside influence from your hands. In other words, the balance point 404 ensures that the self-balancing putter 100 seeks 'square' with an appropriate shaft lean at address and continues to seek square at any point in the back swing, down swing and impact.

Figure 5A:
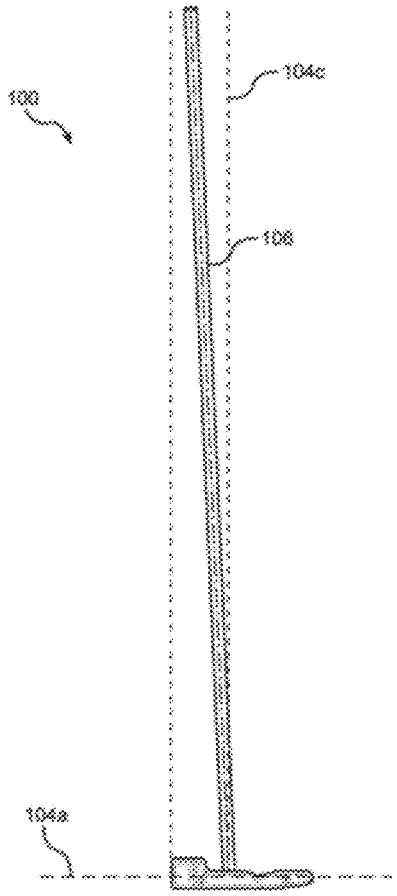
FIGS. 5A-B illustrate side views of the self-balancing putter with forward and rearward leaning shafts, respectively.

FIG. 5A illustrates a side view (i.e., down the y-axis) of the self-balancing putter 100. FIG. 5A shows a forward lean of the shaft 106. The shaft 106 lies entirely in the lie angle plane 302 of FIG. 3, i.e., the shaft 106 is in the lie angle plane 302 and starts 90 degrees to the lie angle axis (which is parallel to the x-axis 104*a*). The shaft 106 is tilted from this position toward the face of the self-balancing putter 100 under current golf rules. This tilt is called forward lean and typically is moved forward so the top center line end point of the shaft is approximately 0.75 inches behind the face of the self-balancing putter 100 (about 1.7 degrees) but is not limited to that. In this configuration, a shaft with forward lean is in the lower front quadrant (+x, +y) as shown in FIG. 4A.

Figure 5B:
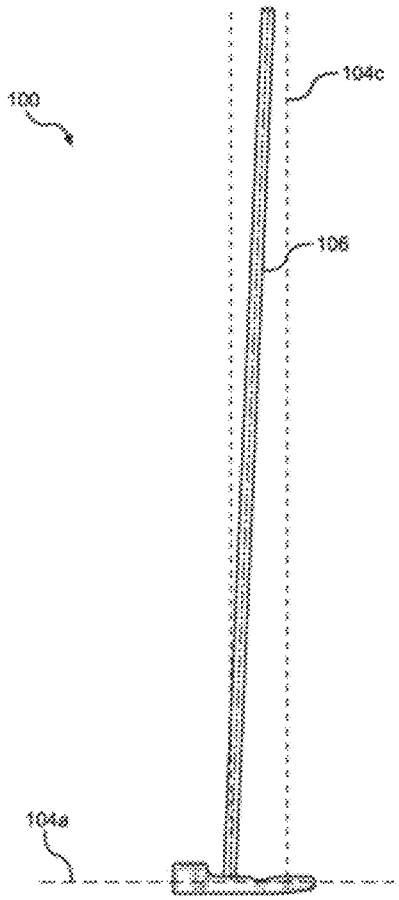

As described above, it is also possible to achieve a self-balancing putter 100 that seeks square and that has a rearward leaning shaft. This is particularly useful for putters known as face-on or side saddle putters having longer shafts measuring approximately 37 inches or more. FIG. 5B illustrates a side view (i.e., down the y-axis) of the self-balancing putter 100 with a rearward leaning shaft 106. As in the embodiment of FIG. 5A with a forward leaning shaft, the self-balancing putter 100 has a shaft 106 that lies entirely in the lie angle plane 302 of FIG. 3, i.e., the shaft 106 is in the lie angle plane 302 and starts 90 degrees to the lie angle axis (which is parallel to the x-axis 104*a*). The shaft 106 in this embodiment is tilted from this position away from the face of the self-balancing putter 100 under current golf rules. This tilt is called rearward lean and is angled in a rearward direction so the top center line end point of the connection point of the shaft is closer to the putter face than a similarly shaped forward leaning shaft with the same center of gravity. The actual measured distance between the connection point and the face varies depending on the shape of the putter. The shaft is in the range of approximately 38-45 inches long. This results in the rearward shaft angle lean being in the range of approximately ½ to 10 degrees which are the limits prescribed by the USGA. It should be understood that even for golf club shafts with measurements outside these ranges, the invention would still function. For clubs having these characteristics, the shaft with rearward lean is in the upper front quadrant (−x, +y) as shown in FIG. 4B. In either case, the center of gravity is still located under the z-axis of the shaft.

The benefit of a rearward leaning shaft is for use with side saddle putting so the putter head is positioned in front of the golfer's lead foot and so that the golfer is able to use stereoscopic vision.

Figure 6A:
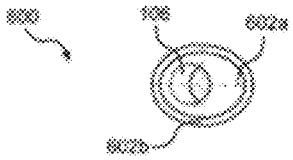
FIG. 6A illustrates a bottom view of the example of an elliptical grip.
Figure 6B:
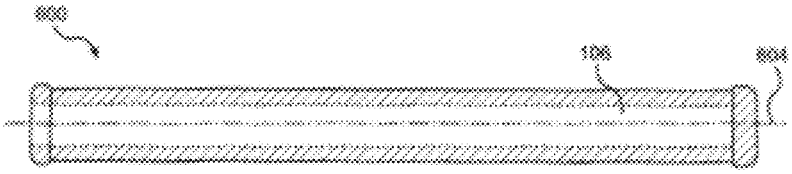
FIG. 6B illustrates a side view of the example of an elliptical grip.
Figure 6C:
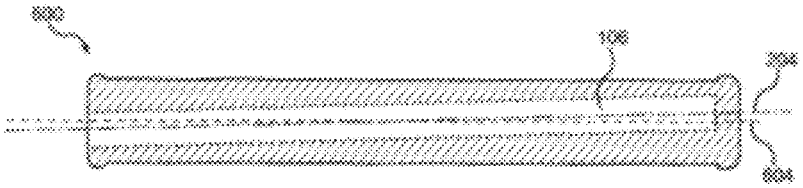
FIG. 6C illustrates a front view of the example of an elliptical grip.

FIGS. 6A, 6B and 6C illustrate an example of an elongated grip that is generally elliptical in shape. FIG. 6A illustrates a bottom view of the example of an elliptical grip 600; FIG. 6B illustrates a side view of the example of an elliptical grip; and FIG. 6C illustrates a front view of the example of an elliptical grip. The elliptical grip 600 can provide a better grip surface for a user because it is elongated, i.e., the elliptical grip 600 better conforms to the hand of the user during actual use. Additionally or alternatively, the elliptical grip 600 helps the putter to self-align better. That is, the elliptical grip 600 allows the club to be aligned in the user's hand more naturally, providing for a more reproducible stance and, therefore, more consistent putting.

In mathematics, an ellipse is a curve on a plane surrounding two focal points such that a straight line drawn from one of the focal points to any point on the curve and then back to the other focal point has the same length for every point on the curve. The shape of an ellipse (how "elongated" it is) is represented by its eccentricity which for an ellipse can be any number from 0 (the limiting case of a circle) to arbitrarily close to but less than 1. Ellipses are the closed type of conic section: a plane curve that results from the intersection of a cone by a plane. Other elongated shapes (e.g. triangular, rectangular, other non-conforming shapes such as generally elliptical with one or more flat sides), may be substituted for an elliptical shape. For purposes of this application, an elliptical grip will be described and shown. However, it should be understood that other elongated shapes as specified herein may be substituted for the elliptical grip.

FIGS. 6A-C show that the elliptical grip 600 includes a major axis 602*a* and a minor axis 602*b* (collectively "axes 602") which intersect at a center axis 604. Ellipses have two mutually perpendicular axes about which the ellipse is symmetric. These axes intersect at the center axis 604 of the ellipse due to this symmetry. The larger of these two axes, which corresponds to the largest distance between antipodal points on the ellipse, is called the major axis 602*a* or transverse diameter. The smaller of these two axes, and the smallest distance across the ellipse, is called the minor axis 602*b* or conjugate diameter. One of skill in the art will appreciate that the ellipse can include one or more flat sections, i.e., a portion of the elliptical grip 600 can have a portion of the ellipse which is linear rather than curved.

The major axis 602*a* can be perpendicular to the club face (i.e., parallel to the x-z plane defined by the x-axis 104*a* and the z-axis 104*c* of FIG. 1). The maximum diameter of the major axis 602*a* is 1.750 inches under current USGA rules. Typically, the major axis 602*a* will have a diameter between 0.5 inches and 1.750 inches. This size can be critical to fit comfortably within the hand of the user.

The minor axis 602*b* can be parallel to the club face (i.e., parallel to the y-z plane defined by the y-axis 104*b* and the z-axis 104*c* of FIG. 1). Typically, the minor axis 602*b* will have a diameter of between 0.95 inches and 1.35 inches. For example, the minor axis 602*b* can be approximately 1.15 inches long. This size can be critical to fit comfortably within the hand of the user.

FIG. 6 shows that center axis 204 of the shaft 106 can be offset relative to the center axis 604 of the elliptical grip 600. That is, the center axis 204 and the center axis 604 are non-parallel to one another, i.e., the center axis 204 is not aligned with or parallel to, but may intersect, the center axis 604. For example, the center axis 604 and the center axis 204 can intersect approximately halfway between the top and the bottom of the elliptical grip. For example, if the elliptical grip is approximately 10.5 inches long, then the center axis 204 and the center axis 604 can intersect approximately 5.25 inches from the bottom of the elliptical grip 600. The angle of the center axis 604 relative to the center axis 204 can be any value in a broad range of values that is, for most practical purposes, between 0.5 degrees and 20 degrees. In setting the angle, it is desirable to consider the length of the putter shaft since the combination of length and angle determines the position of the grip over the putter face. A shorter putter shaft is typically used with a greater angle than a longer putter shaft. In one embodiment, for example, the angle of the center axis 604 relative to the center axis 204 is approximately 1.5 degrees. The center axis 204 may be on the major axis 602*a* (in that case the center axis 204 and the center axis 604 coincide with one another when viewed from the side, such as in FIG. 6B), i.e., each point of the center axis 604 where the shaft 106 is within the elliptical grip 600 may be on the major axis 604.

Golf is a game of "feel" in terms of the manner that a player holds and swings the club, and the force imparted by the player with which the clubface impacts the ball. This is true for any club, but particularly for a putter. Putting requires exacting precision. The lie angle of the putter clubface and the position of the hands on the grip vary each time a player sets up to take a putt. This is further complicated by the fact that players typically hold the putter at different positions along the grip depending on the length of the putt-lower down for a short putt and higher up for a long putt. In practice, a shorter, softer stroke is typically applied to a short putt while a longer, harder stroke is typically applied to a long putt. Each time a player holds the club, there is some degree of variation in the placement of the hands along the length of the grip. That being the case, it is desirable to provide a club that exactly replicates the angle of the club face to the ball irrespective of the position along the length of the grip at which the player holds the club. Grip 600 achieves this result.

Figure 7:
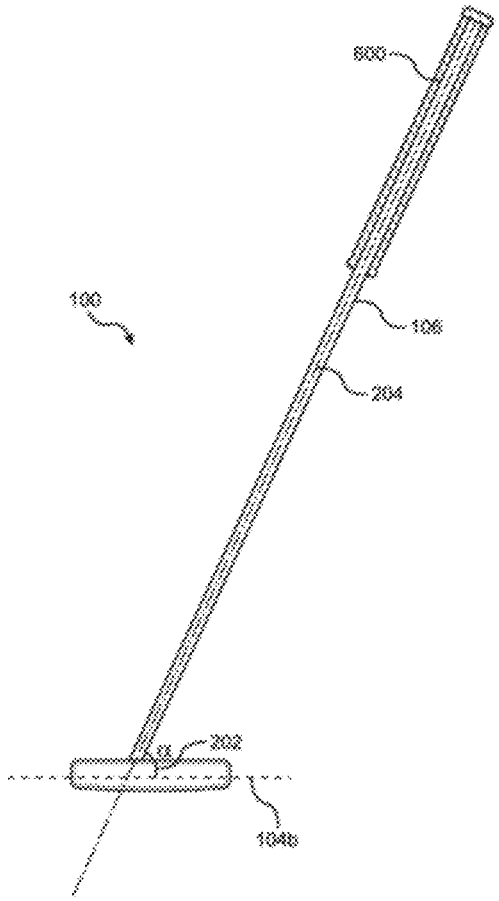
FIG. 7 illustrates a self-balancing putter looking down the x-axis at the face of the putter with a grip having a hollow channel parallel to the center axis of the grip.

FIG. 7 shows the same view of the self-balancing putter as in FIG. 2, looking down x-axis 104*a* at the face of the putter. In this view, center axis 604 of elliptical grip 600 within which shaft 106 is inserted is parallel to center axis 204 of shaft 106.

Figure 8A:
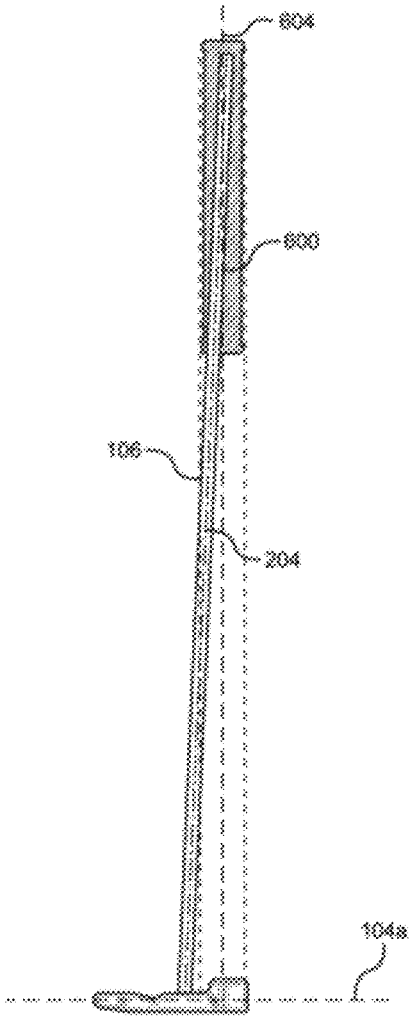
FIGS. 8A-B illustrate a self-balancing putter with forward lean and rearward lean, respectively, looking down the y-axis at the face of the putter with a grip having a hollow channel non-parallel to the center axis of the grip.
Figure 8B:
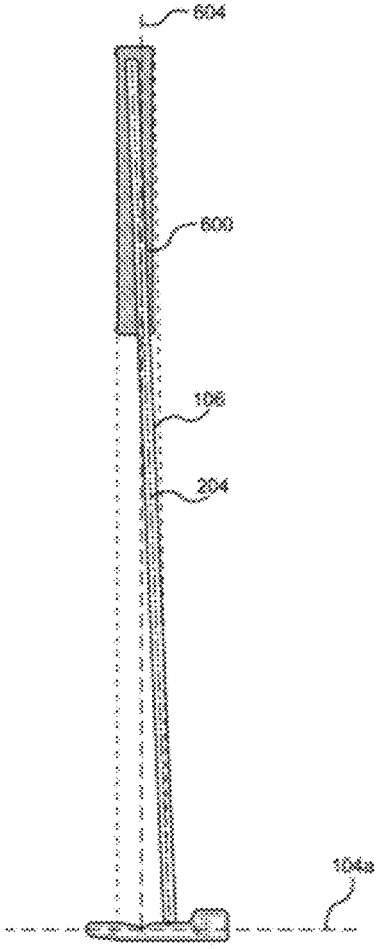

FIGS. 8A-B show the same view of the self-balancing putter as in FIGS. 5A-B with forward lean and rearward lean respectively, looking down the y-axis 104*b* at a 90 degree angle from that of FIG. 7. In these views, center axis 604 of elliptical grip 600 within which shaft 106 is inserted at an angle to center axis 604 is non-parallel to center axis 204 of shaft 106. In other words center axis 604 of grip 600 and center axis 204 of shaft 106 are non-parallel.

Figure 9:
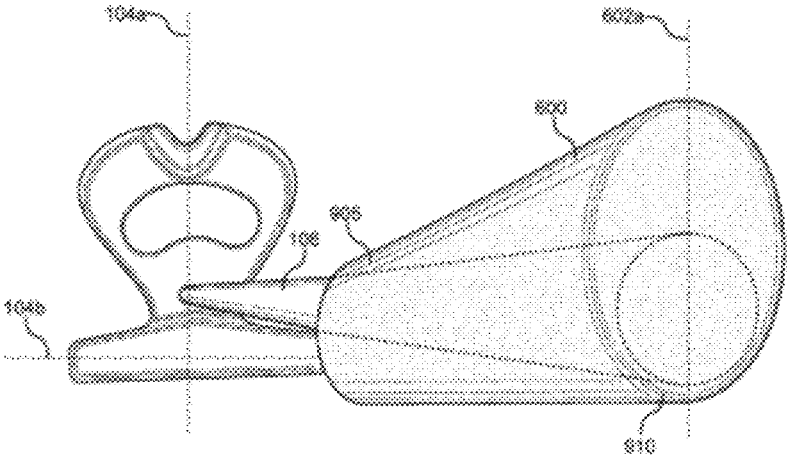
FIG. 9 illustrates a perspective view of the putter from the top of the elliptical grip.
Figures 10A, 10B, 10C:
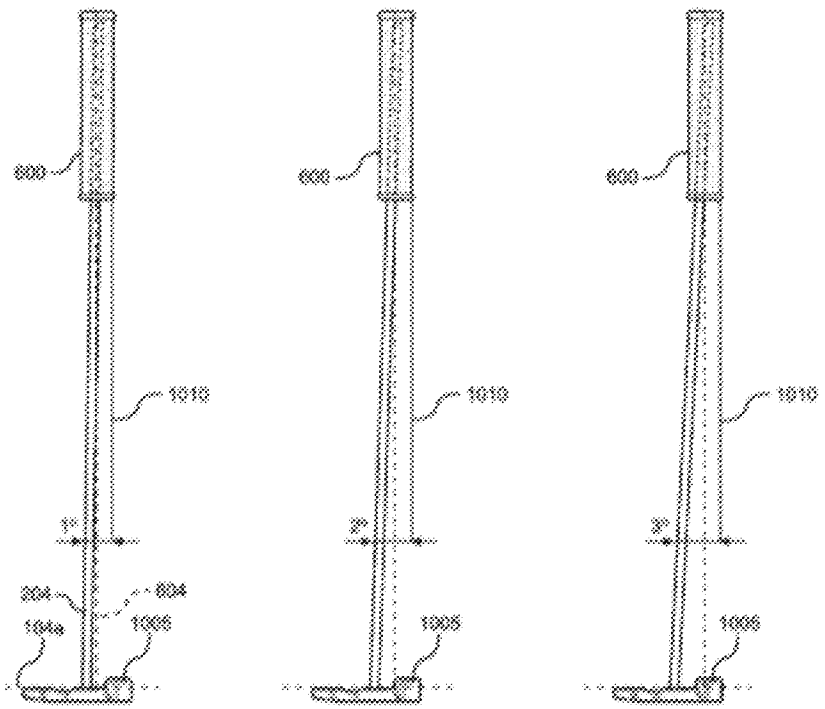
FIGS. 10A-F illustrate six different club grips with club shafts having different forward lean angles.
Figures 10D, 10E, 10F:
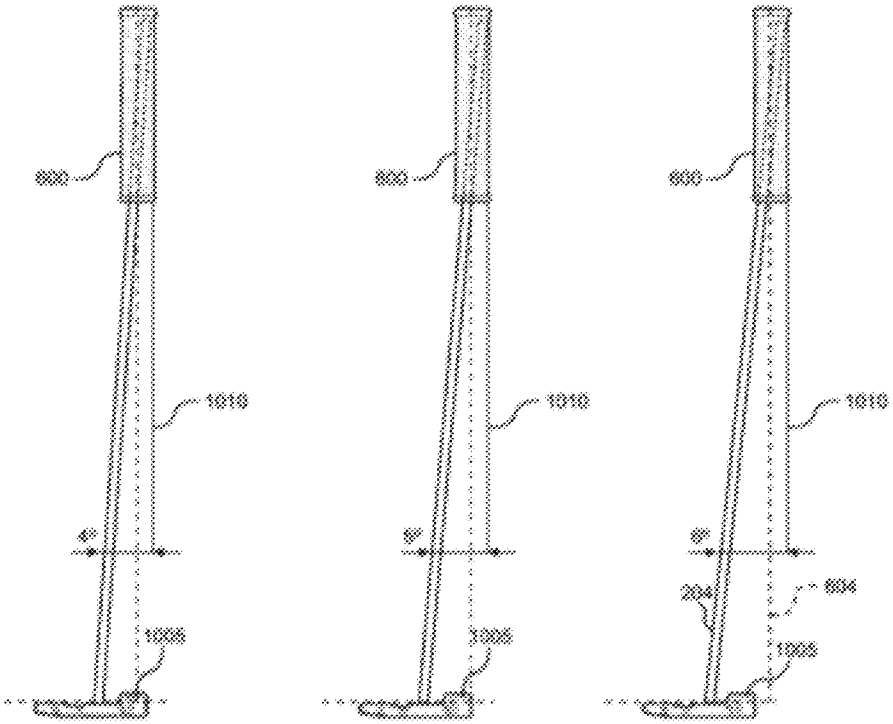
Figure 10I:
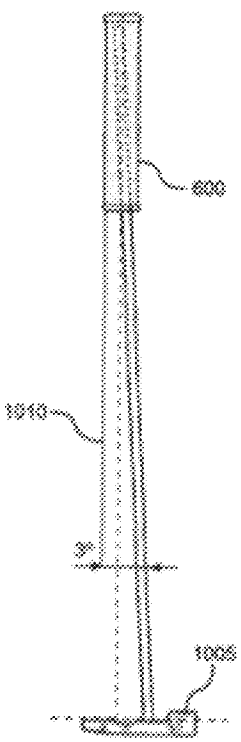
FIGS. 10G-L illustrate six different club grips with club shafts having different rearward lean angles.
Figure 10H:
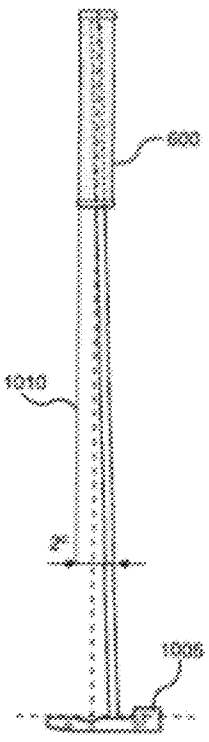
Figure 10G:
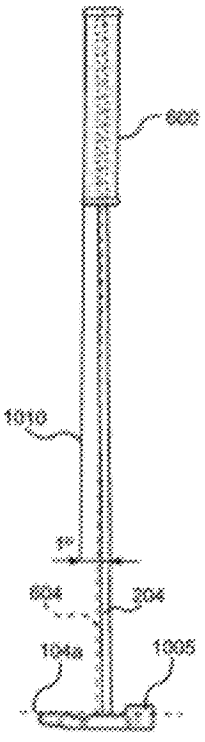
Figure 10L:
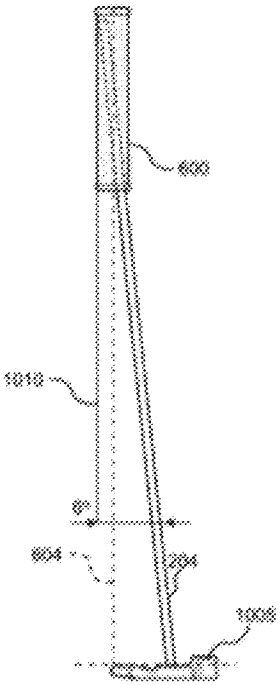
Figure 10K:
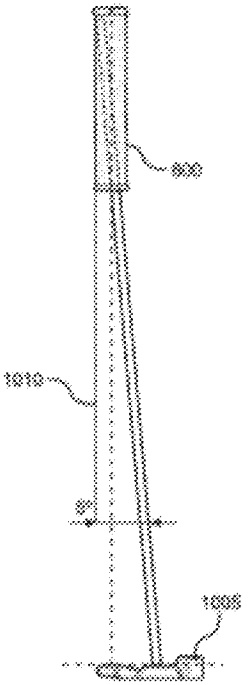
Figure 10J:
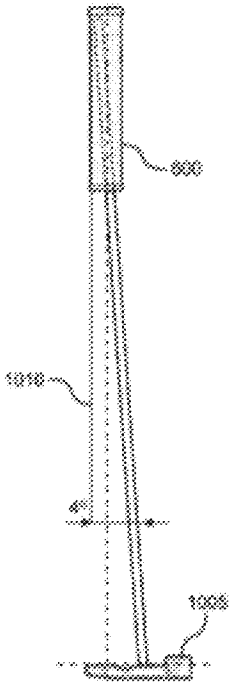

FIG. 9 is a top down perspective view of the putter from the top of the elliptical grip 600, approximately looking down z-axis 104*c*. In this view, it can be seen that shaft 106 is angled within grip 600 so that the exit point of shaft 106 from the bottom of grip 600 is towards back edge 905 of grip 600 where major axis 602*a* is approximately parallel to x-axis 104*a* and perpendicular to y-axis 104*b*. And, the top of shaft 106 is at a front edge 910 of grip 600.

The three views of elliptical grip 600 on shaft 106 as shown in FIGS. 7-9, looking down the respective axes (x-axis 104*a* in FIG. 7; y-axis 104*b* in FIG. 8; and z-axis 104*c* in FIG. 9) show together that center axis 604 of elliptical grip 600 within which shaft 106 is inserted is: (a) non-parallel to center axis 204 of shaft 106 when viewed from a point on the y-axis, (b) parallel to center axis 204 of shaft 106 when viewed from a point on the x-axis; and (c) parallel to major axis 602*a* through the focal points of elliptically shaped grip 600. This is important within the context of a golf club putter because as a player moves their hands to hold grip 600 at any point along the length of grip

600, the angles remain the same relative to the clubface. In particular, the angle between a plane through center axis 204 and the x-y plane remains the same, and the angle between a plane through center axis 604 of grip 600 and the x-y plane remain the same. This results in the lie angle staying constant regardless of the position along grip 600 that the player holds the club. This configuration permits the player to replicate swing dynamics every time they swing the club regardless of the position of the hands along grip 600.

The particular angle between center axis 604 of grip 600 and center axis 204 of shaft 106 depends on the lean of shaft 204. The lean may be forward towards the face of the club or rearward away from the face of the club. As an example, the club shown in FIGS. 7, 8A and 9 has a slight forward lean which can be seen in FIGS. 8A and 9 (but not in FIG. 7), while the club shown in FIG. 8B has a rearward lean. In FIGS. 10A-F, six different putters with different forward lean angles of 1° (FIG. 10A), 2° (FIG. 10B), 3° (FIG. 10C), 4° (FIG. 10D), 5° (FIG. 10E) and 6° (FIG. 10F) are shown. FIGS. 10G-L show the channel within grip 600 angled in a rearward direction to provide a backward lean of 1°-6° degrees, respectively. In each of FIGS. 10A-L, the angle between center axis 604 of grip 600 and center axis 204 of shaft 106 is offset such that the sides of grip 600 as indicated by reference line 1010 extending down from the side of grip 600 are parallel to y-axis 104*b* and to face 1005 of the putter. This configuration achieves the desired result of the same lie angle regardless of the position along the length of the grip that that the player holds the putter.

Figure 11A:
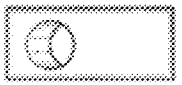
FIGS. 11A-H illustrate eight different club grip cross-sectional shapes.
Figure 11B:
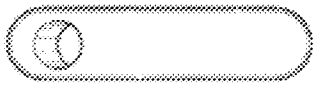
Figure 11C:
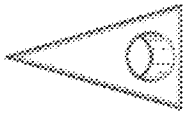
Figure 11D:
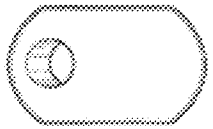
Figure 11E:
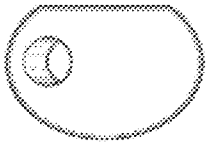
Figure 11F:
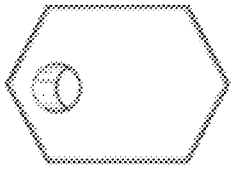
Figure 11G:
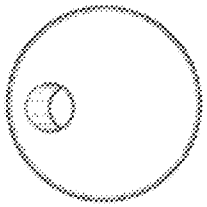
Figure 11H:
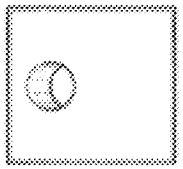

FIGS. 11A-H illustrate eight alternative club grip cross-sectional shapes that may be used as an alternative to the elliptical club grip shown in FIGS. 6-10. The only requirement for the cross-sectional shape of the grip is that it has a width that will accommodate a channel that may be angled through the length of the grip. As shown in FIGS. 6-10, it may be elliptical. Various elongated shapes are shown in FIGS. 11A, 11D and 11E (ellipses with one or two flat sides), FIG. 11B (rectangle), FIGS. 11C (triangle) and 11F (hexagon). However, the grip may also be non-elongated such as FIG. 11G (circular) or FIG. 11H (square). In the case of a non-elongated shape, the dimensions of the grip must be such that the diameter of the channel is sufficiently smaller than the grip so that the channel may be formed at an angle through the grip.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A golf club comprising:

a shaft connected to a grip at a first end of said shaft and to a club head at a second end of said shaft to form a forward lean, said club head comprising a club face configured to make contact with a golf ball;

wherein said first end of the shaft is disposed in a channel in said grip and at an angle with respect to said grip such that a central axis of said shaft is not parallel to a central axis of said grip; and wherein said channel runs within said grip and is dimensioned to secure said grip to said shaft, wherein said channel having a channel axis coincided with the central axis of said shaft but not with the central axis of said grip, said channel comprising a circular cross section with respect to the channel axis;

wherein said channel is angled such that an angle between the grip center axis and the shaft center axis is offset so that the front edge of the grip is aligned with the club face to compensate for the forward lean of the shaft, such that the golf club is configured to maintain a constant lie angle of the shaft center axis relative to a ground surface regardless of a location that along said grip at which the golf club is gripped, and wherein the central axis of said shaft intersects the central axis of said grip to form an angle between the central axis of said shaft and the central axis of said grip when the grip is secured to said shaft to be used by a player, and wherein the club face at least one of: seeks square or has a reduced torque to square the club face, to an arc of stroke when the golf club contacts a golf ball.

2. The golf club of claim 1, wherein the grip is dimensioned such that a diameter of the channel accommodates the shaft inserted in the grip in a slanted manner.

3. The golf club of claim 2, wherein the angle between the center axis of the grip and the center axis of the shaft is offset such that the grip is parallel to the club face of the golf club.

4. The golf club of claim 1, wherein the golf club is adapted such that the player does not need to twist the golf club to form the arc of stroke when the golf club contacts the golf ball.

5. The golf club of claim 1, wherein the center axis of the channel is: (a) non-parallel to the center axis of the grip when viewed from a point on a y-axis, (b) parallel to the center axis of the grip when viewed from a point on a x-axis; and (c) parallel to a major axis when viewed from a focal point of the grip.

6. The golf club of claim 1, wherein an angle between a plane through the center axis of the shaft and a x-y plane remains the same, and an angle between a plane through the center axis of the grip and the x-y plane remain the same.

7. The golf club of claim 1, wherein a front side of the grip aligns over the club face.

8. A golf club comprising:

a straight shaft having a shaft center axis;

a grip at one end of said shaft, said grip having a grip center axis, the grip further comprising a channel configured to receive said shaft therein and having a channel center axis; and a club head at another end of said shaft, said club head comprising a club face adapted to make contact with a golf ball, wherein said golf club is adapted such that the club face seeks square when being swung and making contact with the golf ball;

wherein said grip center axis and said channel center axis are not parallel to one another so that the grip is aligned with the club face; and wherein said channel is configured to have upper and lower ends within the grip and to be angled within said grip to provide a forward lean of said shaft towards said club face, such that the golf club is configured to provide a constant lie angle regardless the location along said grip at which the golf club is gripped, wherein the upper end is located on one side of the grip, and the lower end is located on the other side of said grip.

9. The golf club of claim 8, wherein a back edge of a bottom of said grip providing an exit point of said shaft comprises an edge of said bottom of said grip that is furthest from the club face.

10. The golf club of claim 8, wherein a top of said shaft is at a front edge of said grip.

11. The golf club of claim 8, wherein said grip has an elliptical cross section with respect to the grip center axis such that a first axis in said grip cross section and a second axis in said grip cross section are perpendicular to one another but have different dimensions from one another.

12. The golf club of claim 8, wherein said golf club is adapted such that the club face a reduced torque with respect to the shaft, to an arc of stroke when the golf club contacts the golf ball.

13. The golf club of claim 8, wherein the channel center axis is: (a) non-parallel to the grip center axis when viewed from a point on a y-axis, (b) parallel to the grip center axis when viewed from a point on a x-axis; and (c) parallel to a major axis when viewed from a focal point of the grip.

14. The golf club of claim 8, wherein the orientation of the club face with respect to the golf ball remains the same irrespective of the position along a longitudinal direction of the grip at which the player holds the club when swung.

15. The golf club of claim 8, wherein an angle between a plane through the shaft center axis and a x-y plane remains the same, and an angle between a plane through the grip center axis and the x-y plane remain the same, enabling the lie angle to remain constant regardless of the position along the grip that the player holds the club.

16. The golf club of claim 8, wherein a front side of the grip aligns over the club face.

17. The golf club of claim 8, wherein said grip comprising one of an elliptical cross section, a rectangular cross section, a triangular cross section, a hexagonal cross section, a circular cross section, or a square cross section with respect to the channel axis.

18. A golf club comprising:

a straight shaft having a shaft center axis;

a grip at one end of said shaft, said grip having a grip center axis, the grip further comprising a channel that is non-parallel to the grip center axis and adapted to receive said shaft therein and having a channel center axis, said channel of the grip is adapted to be formed within the grip at an angle with respect to an exterior surface of the grip; and a club head at another end of said shaft having a forward lean and directly connected to said shaft, said club head comprising a club face configured to make contact with a golf ball;

wherein said grip center axis and said channel center axis are not parallel to one another; and wherein said channel is angled within said grip so as to provide a lean of said shaft in a direction forward of said club face, and the channel center axis is angled such that a lie angle of the golf club is constant regardless of a location that the golf club is grippable along the grip.

19. The golf club of claim 18, wherein said grip has an elliptical cross section with respect to the grip center axis such that a first axis in said grip cross section and a second axis in said grip cross section are perpendicular to one another but have different dimensions from one another.

20. The golf club of claim 19, wherein said golf club is adapted such that the club face at least one of: seeks square or provides zero torque with respect to the shaft, to an arc of stroke when the golf club contacts a golf ball.

21. The golf club of claim 19, wherein said grip is adapted to be sized and to include a width that accommodates the channel that is angled through a length of the grip.

22. The golf club of claim 18, wherein the channel center axis is: (a) non-parallel to the grip center axis when viewed from a point on a y-axis, (b) parallel to the grip center axis when viewed from a point on a x-axis; and (c) parallel to a major axis when viewed from a focal point of the grip.

23. The golf club of claim 18, wherein an angle between a plane through the shaft center axis and a x-y plane remains the same, and an angle between a plane through the grip center axis and the x-y plane remain the same, enabling the lie angle to remain constant regardless of the position along the grip that the club is gripped.

24. The golf club of claim 18, wherein a front side of the grip aligns over the club face.

25. A golf club comprising:

a shaft having a shaft center axis;

a grip at one end of said shaft, said grip having a grip center axis, and a front edge of the grip, the grip further comprising a channel configured to receive said shaft therein and having a channel center axis, said grip has a cross section relative to a longitudinal direction with respect to the grip center axis defined by a first axis and a second axis with the first axis having different dimension than the second axis; and a club head at another end of said shaft having a forward lean, said club head comprising a club face configured to make contact with a golf ball, and the front edge of the grip aligned with said club face, wherein said grip center axis and said channel center axis are not parallel to one another, wherein said channel is angled within and through said grip, wherein the shaft center axis intersects the grip center axis to form an angle between the shaft center axis and the grip center axis, wherein the angle between the shaft center axis and the grip center axis is in the range of 0.5° to 20°, and wherein the golf club is configured to enable the club face to at least one of: resist or correct twisting of said shaft during an arc of stroke when the golf club is making contact with a golf ball.

26. The golf club of claim 25, wherein said grip has an elliptical cross section with respect to the grip center axis such that the first axis in said grip cross section and the second axis in said grip cross section are perpendicular to one another.

27. The golf club of claim 26, wherein said golf club is adapted such that the club face at least one of: seeks square or provides zero torque with respect to the shaft, to an arc of stroke when the golf club contacts a golf ball.

28. The golf club of claim 26, wherein said grip is adapted to be sized and to include a width that accommodates the channel that is angled through a length of the grip.

29. The golf club of claim 25, wherein an angle between a plane through the shaft center axis and a x-y plane remains the same, and an angle between a plane through the grip center axis and the x-y plane remain the same, enabling a lie angle to remain constant regardless of the position along the grip that the player holds the club.

* * * * *